United States Patent [19]

Klip

[11] 3,971,513

[45] July 27, 1976

[54] DREDGE PUMP

[75] Inventor: Johan Klip, Berkenwoude, Netherlands

[73] Assignees: Konijn Machinebouw B.V., Hoorn; Bagger-en Constructie Bedrijf Johan Klip B.V., Berkenwoude, both of Netherlands

[22] Filed: May 13, 1975

[21] Appl. No.: 577,008

[30] Foreign Application Priority Data

May 22, 1974 Netherlands ..... 7406866

[52] U.S. Cl. ..... 241/46 R; 241/185 A

[51] Int. Cl.[2] ..... B02C 23/36

[58] Field of Search ..... 241/46 R, 46.08, 46.11, 241/46.17, 185 A, 188 R

[56] References Cited

UNITED STATES PATENTS

| | | | |
|---|---|---|---|
| 2,027,015 | 1/1936 | Bell | 241/46 R |
| 2,245,035 | 6/1941 | Hartman | 241/185 A |
| 2,265,758 | 12/1941 | Klossen | 241/46 R |
| 2,975,714 | 3/1961 | Nechine | 241/185 A |

*Primary Examiner*—Granville Y. Custer, Jr.
*Attorney, Agent, or Firm*—Haseltine, Lake & Waters

[57] ABSTRACT

Dredge pump, comprising a volute pump casing, with a lateral, round suction opening and with an outlet. In this pump casing an impeller is mounted which consists of a front plate, a back plate and two blades connecting the front plate and the back plate to each other. One of these blades, which has at least substantially the form of a circular arc at its end nearest the axis of rotation and subsequently increases in radius, forms a passage which is connected through an opening in the front plate to the suction opening of the pump casing and which is passed in the direction of its lateral outlet by all dredged material which is to be pumped. The passage formed by the first blade increases gradually in width from the central inlet towards the lateral outlet, said central inlet being bounded by the part of the blade having at least substantially the form of a circular arc. The front plate and the back plate have a cutting edge along at least the greater part of their periphery, this cutting edge being located in their outer surface.

9 Claims, 4 Drawing Figures

DREDGE PUMP

BACKGROUND OF THE INVENTION

The invention relates to a dredge pump, consisting of a volute pump casing, with a lateral, round suction opening and with an outlet, in which pump casing an impeller is mounted which consists of a front plate with an opening adjoining the suction opening of the pump casing, of a back plate which is connected to a drive shaft supported in the pump casing and coupled to a motor, and of two blades extending between the front plate and the back plate and connecting these to each other, one of which blades, which has at least substantially the form of a circular arc at its end nearest the axis of rotation and subsequently increases in radius, forms a passage which is connected through the opening in the front plate to the suction opening of the pump casing and which is passed in the direction of its lateral outlet by all dredged material which is to be pumped, one end of the second blade adjoining the aforementioned end of the first blade radially on the outside and the other end of this second blade lying at least substantially diametrically opposite the other end of the first blade, the two blades, viewed from the axis of rotation, having a concave curvature.

Prior art embodiments of such dredge pumps frequently have the disadvantage of becoming very rapidly clogged, especially when pumping dredged material comprising large solid pieces, such as, for example, stones and lumps of peat or clay, and or containing a great deal of vegetation.

SUMMARY OF THE INVENTION

It is an object of the present invention to provide a dredge pump which offers major advantages in this respect.

To this end, the dredge pump according to the invention is characterized in that the passage formed by the first blade increases gradually in width from the central inlet towards the lateral outlet, said central inlet being bounded by the part of the blade having at least substantially the form of a circular arc, and in that the front plate and the back plate having a cutting edge along at least the greater part of their periphery, said cutting edge being located in their outer surface.

As a result of the shape of the passage in the impeller, which progressively increases in width from the central inlet towards the lateral outlet, clogging in this passage is prevented, so that the dredged material as well as the solid pieces and vegetation contained therein are subjected to undisturbed lateral discharge from the passage under the action of the centrifugal force. The dredged material to be pumped, having reached the pump casing through the passage in the impeller, is pressed primarily towards the pump outlet by the second blade. During operation, there will be a partial vacuum in the hollow space on the rear side of this second blade between the two blades, so that the dredged material still present behind this second blade in the pump casing can to some extent be brought into a whirling motion and thus still be effectively conveyed by the first blade towards the pump outlet.

The sharp edges of the front plate and of the back plate apply a cutting action to the solid pieces and the vegetation in the dredged material and furthermore impart a whirling motion to the dredged material, causing the danger of clogging in the pump casing to be counteracted. The result is at the same time that no elongate vegetable matter is wound about the drive shaft of the impeller. In addition, the cutting edges of the front plate and of the back plate of the impeller will have a cleaning effect upon the immediately adjacent walls of the pump casing.

In order to support the cutting action of the edges of the front plate and of the back plate of the impeller the two blades may be provided on their front side, as seen in the direction of rotation, with a rib which is parallel to the front plate and the back plate and which has a cutting edge. These ribs likewise serve for cutting through elongate vegetable matter and for reducing the size of large solid pieces in the dredged material. Thus, plug formation in the pump casing is prevented, and the danger of clogging is still further reduced.

In a preferred embodiment of the dredged pump according to the invention, the front plate and the back plate of the impeller have two curved end edges which are symmetric with respect to the axial plane passing through the adjoining ends of the two blades, each edge ending on one side at the location of the outer end of one of the blades.

DESCRIPTION OF A PREFERRED EMBODIMENT

Figure 2:
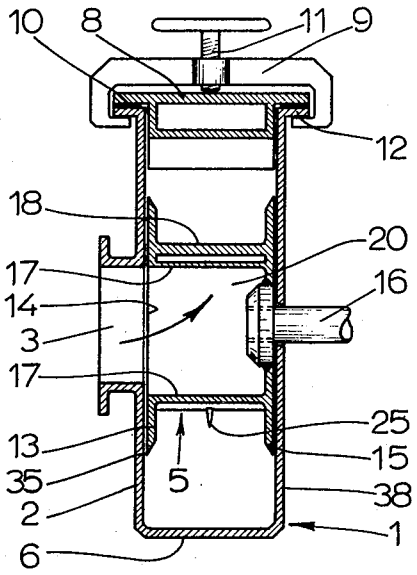
FIG. 2 is a transverse section of the dredge pump along the plane II—II in FIG. 1.

The dredge pump according to the invention, shown in the drawings by way of example, consists of a volute pump casing 1 with a lateral, round suction opening 3 formed in its front wall 2 and with an outlet 4. An impeller 5 is mounted in this pump casing 1.

Figure 1:
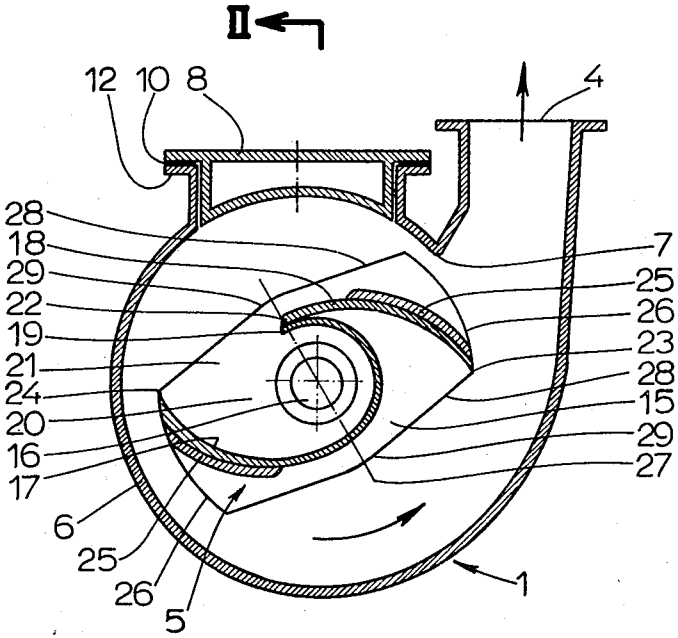
FIG. 1 is a schematic longitudinal section of an embodiment of a dredge pump according to the invention.

A shown particularly in FIG. 1, the volute lateral wall 6 of the pump casing 1 increases only slightly in radius from the throat 7 over the first half of its path. This radius then gradually increases, until the pump outlet 4 is reached. The relatively narrow initial area is important for the pressure build-up in the pump casing 1; the expanding second area is important for a smooth discharge of the dredged material which is to be pumped.

The pump casing 1 is provided with a detachable inspection door 8, which is pressed together with an interposed sealing gasket 10 on a flange 12 of the pump casing 1 with the aid of a clamp 9, use being made of a central screw spindle 11 which is provided with a grip. This door 8 can be removed by unscrewing this screw spindle 11 and detaching the clamp 9.

The impeller 5 consists of a front plate 13 with an opening 14 a portion of which adjoins the suction opening 3 of the pump casing 1, of a back plate 15 which is connected to a drive shaft 16 supported in the pump casing 1 and coupled to a motor (not shown), and of two blades 17 and 18 which extend between the front plate 13 and the back plate 15 and are fastened thereto by welding.

From its end 19 which is located near the drive shaft 16, the blade 17 first follows a substantially semi-circular path, and subsequently increases in radius in a more or less helical manner. This first blade 17 forms a passage 20 which is connected through the opening 14 in the front plate 13 to the suction opening 3 of the pump casing 1 and which is passed in the direction of its lateral outlet 21 by all dredged material which is to be pumped. The impeller 5 is thus designed as a single passage impeller.

The end 22 of the blade 18 adjoins the end 19 of the blade 17 radially on the outside, while the end 23 of the blade 18 is at least substantially diametrically opposite the end 24 of the blade 17. As FIG. 1 indicates, the two blades 17, 18, when viewed from the drive shaft 16, have a concave curvature.

The passage 20 formed by the blade 17 gradually increases in width from the central inlet towards the lateral outlet 21, said central inlet being bounded by the part of the blade 17 which is at least substantially semi-circular. Due to this increase in width the possibility of clogging in this passage 20 is precluded. The two blades 17, 18 are provided on their front side, as seen in the direction of rotation, with ribs 25 having a cutting edge. These ribs 25 are positioned centrally between the front plate 13 and the back plate 15 and are parallel to these plates 13, 15.

The front plate 13 and the back plate 15 of the impeller 5 have two curved end edges 26 which are symmetric with respect to the axial plane 27 passing through the adjoining ends 19, 22 of the two blades 17, 18. Each end edge 26 ends on one side at the location of the outer end 23 or 24 of the blade 18 or 17. The end edges 26 of the front plate 13 and of the back plate 15 of the impeller 5 have the form of a circular arc. Their central point lies on the central axis of the drive shaft 16. The smallest distance between the ends of the end edges 26 of the front plate 13 and of the back plate 15, respectively, of the impeller 5 amounts to approximately half the greatest distance between these ends.

Further, the back plate 15 of the impeller 5 has two side edges 28, which connect the end edges 26, and which diverge from each of the two end edges 26 towards the axial plane 27. Each side edge 28 comprises a central portion 29 having the form of a circular arc whose central point lies on the central axis of the drive shaft 16.

The smallest distance between the ends of the end edges 26 of the back plate 15 of the impeller 5 amounts to approximately three quarters of the width of the back plate 15 in the axial plane 27.

Figure 3:
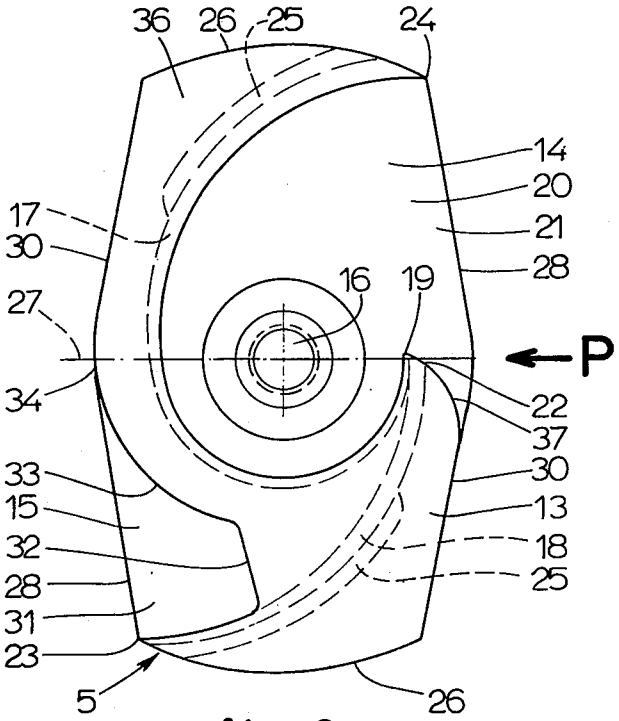
FIG. 3 is a front view of the impeller of the dredge pump according to FIG. 1.

The front plate 13 of the impeller 5 has two side edges 30 which connect the end edges 26 and which, as FIG. 3 indicates, are partly in line with the side edges 28 of the back plate 15. One side edge 30 of the front plate 13 follows the blade 17 and bounds the opening 14, the circumference of which corresponds to that of the passage 20. The other side edge 30 of the front plate 13 comprises a recess 31, which follows in part the rear side of the blade 18, and has a straight edge 32 at approximately right angles thereto, while this recess 31 is further bounded by a curved portion 33. This curved portion 33 merges approximately in the axial plane 27 into a central portion 34 of this side edge 30, which has the form of a circular arc. The central point of this central portion 34 lies on the central axis of the drive shaft 16. The front plate 13 and the back plate 15 of the impeller 5 have a thickness which amounts to approximately 1/40 of the greatest distance between the ends of the end edges 26 of the front plate 13 and of the back plate 15, respectively.

In an impeller 5 which has given excellent performance in tests, the smallest distance between the ends of the end edges 26 of the front plate 13 and of the back plate 15, respectively, amounts to about 18 centimeters, and these end edges 26 have a radius of about 20 centimeters, while the radius of the central portion of the side edges 28 of the back plate 15 amounts to about 12 centimeters. The front plate 13 and the back plate 15 of this impeller 5 each have a thickness of about 1 centimeter.

Figure 4:
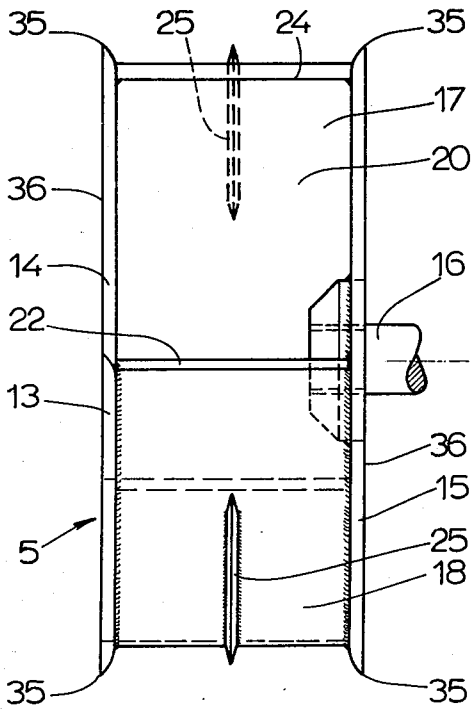
FIG. 4 is a side view of the impeller according to FIG. 3, seen in the direction of the arrow P.

As shown particularly in FIG. 4, the front plate 13 and the back plate 15 each have a cutting edge 35 along a large part of their periphery, this cutting edge 35 being located in their outer surface 36. The back plate 15 has a cutting edge 35 along almost its entire periphery, which is constituted by the two end edges 26 and the two side edges 28. This cutting edge 35 is only interrupted over a very small distance at the location of the blade ends 23, 24. Of the front plate 13, first of all the end edges 26 are provided with a cutting edge 35, which again is interrupted over a very short distance at the location of the blade ends 23, 24. One side edge 30 of the front plate 13 is provided with a cutting edge 35 along the part which is in line with the side edge 28 of the back plate 15 as well as along the rounded portion 37. The other side edge 30 of the front plate 13 has a cutting edge 35 along the part which is in line with the side edge of the back plate 15 and furthermore along the edges 33 en 32 of the recess 31. The other parts of the side edges 30 of the front plate 13, which adjoin the blades 17, 18 are made without cutting edge. The ends 23, 24 of the blades 18, 17 are also sharp-edged, and the adjoining blade ends 19, 22 likewise terminate in a relatively sharp edge.

The front plate 13 and the back plate 15 are arranged with a minimum of clearance along the front wall 2 and the back wall 38 of the pump casing 1 (FIG. 2).

The front plate 13 and the back plate 15, which project outside the blades 17, 18 impart great rigidity to the impeller 5. Furthermore, this front plate 13 and back plate 15 substantially protect the side walls 2, 38 of the pump casing 1, thus counteracting wear of these side walls. Wear of the impeller 5 is also reduced to a minimum by the described design of the front plate 13 and the back plate 15.

During operation, the dredged material, having passed through the suction opening 3 of the pump casing 1, reaches the passage 20 on the impeller 5, which passage is bounded by the blade 17 which has the form of a circular arc over approximately 180° and subsequently follows a helical course. Since the passage 20 in the impeller 5 increases in width from the central inlet towards the lateral outlet 21, no clogging can take place in this passage 20.

The rapidly rotating impeller 5, the rotation rate of which may amount to 1000 revolutions per minute for example, applies a cutting action to the solid pieces and the vegetable matter in the dredged material as a result both of the cutting edge 35 on a large part of the periphery of the front plate 13 and of the back plate 15 and of the presence of the cutting edge on the ribs 25 on the two blades 17, 18. In addition, the cutting edges 35 of the front plate 13 and of the back plate 15 will force the dredged material towards the central region of the pump casing 1 and impart a whirling motion to the dredged material. As a result, the danger of clogging is virtually eliminated.

Furthermore, the hollow space on the rear side of the blade 18 between the blades 17, 18 where a partial vacuum prevails during operation, will impart a whirling motion to any dredged material which, after having left the passage 20, has not been pressed directly towards the outlet 4 by the blade 18 and which thus is present behind the blade 18 in the pump casing 1. In this manner the removal of such material by the blade 17 towards the outlet 4 is intensified.

The invention is not restricted to the embodiment shown in the drawing, which can be varied in several manners within the scope of the appended claims.

I claim:

1. Dredge pump, consisting of a volute pump casing, with a lateral, round suction opening and with an outlet, in which pump casing an impeller is mounted which consists of a front plate with an opening adjoining the suction opening of the pump casing, of a back plate which is connected to a drive shaft supported in the pump casing and coupled to a motor, and of two blades extending between the front plate and the back plate and connecting these to each other, one of which blades, which has at least substantially the form of a circular arc at its end nearest the axis of rotation and subsequently increases in radius, forms a passage which is connected through the opening in the front plate to the suction opening of the pump casing and which is passed in the direction of its lateral outlet by all dredged material which is to be pumped, one end of the second blade adjoining the aforementioned end of the first blade radially on the outside and the other end of this second blade lying at least substantially diametrically opposite the other end of the first blade, the two blades, viewed from the axis of rotation, having a concave curvature, the passages formed by the first blade increasing gradually in width from the central inlet towards the lateral outlet, said central inlet being bounded by the part of the blade having at least substantially the form of a circular arc, the front plate and the back plate having a cutting edge along at least the greater part of their periphery, said cutting edge being located in their outer surface, said front plate and said back plate of the impeller having two curved end edges which are symmetrical with respect to the axial plane passing through the adjoining ends of the two blades, each edge ending on one side at the location of the outer end of one of the blades.

2. Dredge pump according to claim 1, wherein the said end edges of the front plate and of the back plate of the impeller have the form of a circular arc having their central point lying on the central axis of the drive shaft.

3. Dredge pump according to claim 2, wherein the smallest distance between the ends of the end edges of the front plate and of the back plate, respectively, of the impeller amount to approximately half the greatest distance between these ends.

4. Dredge pump according to claim 1, wherein the back plate of the impeller has two side edges, which connect the end edges and which diverge from each of the two end edges towards the aforementioned axial plane, said side edges comprising a central portion having the form of a circular arc whose central point lies on the central axis of the drive shaft.

5. Dredge pump according to claim 4, wherein the smallest distance between the ends of the end edges of the back plate of the impeller amount to approximately three quarters the width of the back plate in the aforementioned axial plane.

6. Dredge pump according to claim 1, wherein the front plate of the impeller has two side edges which connect the end edges and which are partly in line with the side edges of the back plate, one side edge of the front plate following the first blade and bounding the opening in the front plate, the circumference of which corresponds to that of the passage, the other side edge of the front plate comprising a recess, which follows in part the second blade, subsequently has a straight edge at approximately right angles thereto, and further has a curved edge which merges approximately in the aforementioned axial plane into a central portion of this side edge having the form of a circular arc, the central point of which lies on the central axis of the drive shaft.

7. Dredge pump, consisting of a volute pump casing, with a lateral, round suction opening and with an outlet, in which pump casing an impeller is mounted which consists of a front plate with an opening adjoining the suction opening of the pump casing, of a back plate which is connected to a drive shaft supported in the pump casing and coupled to a motor, and of two blades extending between the front plate and the back plate and connecting these to each other, one of which blades, which has at least substantially the form of a circular arc at its end nearest the axis of rotation and subsequently increases in radius, forms a passage which is connected through the opening in the front plate to the suction opening of the pump casing and which is passed in the direction of its lateral outlet by all dredged material which is to be pumped, one end of the second blade adjoining the aforementioned end of the first blade radially on the outside and the other end of this second blade lying at least substantially diametrically opposite the other end of the first blade, the two blades, viewed from the axis of rotation, having a concave curvature, the passage formed by the first blade increasing gradually in width from the central inlet towards the lateral outlet, said central inlet being bounded by the part of the blade having at least substantially the form of a circular arc, the front plate and the back plate having a cutting edge along at least the greater part of their periphery, said cutting edge being located in their outer surface, the two blades being provided on their front side, as seen in the direction of rotation, with a rib which is parallel to the front plate and the back plate and which has an outer cutting edge, said front plate and said back plate of the impeller having two curved end edges which are symmetrical with respect to the axial plane passing through the adjoining ends of the two blades, each edge ending on one side at the location of the outer end of one of the blades.

8. Dredge pump according to claim 7, wherein the front plate and the back plate of the impeller have a thickness amounting to approximately one fortieth the greatest distance between the ends of the end edges of the front plate and of the back plate, respectively.

9. Dredge pump according to claim 8, wherein the thickness of the front plate and of the back plate amount to approximately 1 centimeter.

* * * * *